US006926224B2

(12) United States Patent
Föhr et al.

(10) Patent No.: US 6,926,224 B2
(45) Date of Patent: Aug. 9, 2005

(54) METHOD AND DEVICE IN WINDING OF A WEB

(75) Inventors: Heikki Föhr, Järvenpää (FI); Markku Järvensivu, Valkeakoski (FI); Pauli Koutonen, Jokela (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/479,990

(22) PCT Filed: Jun. 6, 2002

(86) PCT No.: PCT/FI02/00485

§ 371 (c)(1),
(2), (4) Date: Dec. 5, 2003

(87) PCT Pub. No.: WO02/098774

PCT Pub. Date: Dec. 12, 2002

(65) Prior Publication Data

US 2004/0159737 A1 Aug. 19, 2004

(30) Foreign Application Priority Data

Jun. 6, 2001 (FI) ..... 20011197

(51) Int. Cl.[7] ..... B65H 35/04

(52) U.S. Cl. ..... 242/527.2; 242/541.3; 242/542.2; 242/533; 242/527.6

(58) Field of Search ..... 242/527, 527.2–527.4, 242/527.6, 541.3, 533.2, 542.3, 533, 533.1

(56) References Cited

U.S. PATENT DOCUMENTS

| | | | | | |
|---|---|---|---|---|---|
| 3,567,144 | A | * | 3/1971 | Dambroth | 242/527.2 |
| 3,841,578 | A | | 10/1974 | Dörfel | |
| 4,183,474 | A | | 1/1980 | Schöonmeier | |
| 4,370,193 | A | * | 1/1983 | Knauthe | 242/527.2 |
| 4,408,727 | A | | 10/1983 | Dropczynski | |
| 4,516,735 | A | * | 5/1985 | Snygg | 242/527.3 |
| 4,601,441 | A | * | 7/1986 | Oinonen et al. | 242/527.3 |
| 4,635,867 | A | * | 1/1987 | Kytonen | 242/527.2 |
| 4,709,867 | A | | 12/1987 | Oinonen | |
| 4,842,209 | A | | 6/1989 | Saukkonen | |
| 4,931,130 | A | | 6/1990 | Biagiotti | |
| 4,988,052 | A | * | 1/1991 | Urban | 242/524.1 |
| 5,653,399 | A | | 8/1997 | Koutonen et al. | |
| 5,653,401 | A | | 8/1997 | Biagiotti | |
| 5,938,144 | A | * | 8/1999 | Kaipf et al. | 242/530.4 |

FOREIGN PATENT DOCUMENTS

| | | |
|---|---|---|
| FI | 781849 | 6/1982 |
| FI | 69821 | 5/1986 |
| FI | 81551 | 7/1990 |
| FI | 100324 | 6/1996 |
| WO | WO 02/098774 A1 | 12/2002 |

OTHER PUBLICATIONS

Office Action with Search report issued in FI 20040719.
Search report issued in Finnish Patent Application No. 20011197.
International Preliminary Examination Report issued in PCT/FI02/00485.
International Search Report issued in PCT/FI02/00485.

* cited by examiner

*Primary Examiner*—John M. Jillions
*Assistant Examiner*—Sang Kim
(74) *Attorney, Agent, or Firm*—Stiennon & Stiennon

(57) ABSTRACT

A web is wound onto a core (21) while supported by winding drums (11, 12). The web is cut by a cutting device (19), and a finished web roll (10) is removed by a transfer device (16). A new core (21) is moved to a space between the winding drums (11, 12), and the winding is stopped to remove the finished roll (10) and to start a new roll. The core is moved onto support of one winding drum and a support member (22) and held in place by the support member (22) until the movable winding drum (11, 12) has been moved to the starting position of winding.

19 Claims, 3 Drawing Sheets

METHOD AND DEVICE IN WINDING OF A WEB

CROSS REFERENCES TO RELATED APPLICATIONS

This application is a National Stage Application of International Application No. PCT/FI02/00485, filed Jun. 6, 2002, and claims priority on Finnish Application No. 20011197, Filed Jun. 6, 2001, the disclosure of which is incorporated by reference herein.

STATEMENT AS TO RIGHTS TO INVENTIONS MADE UNDER-V FEDERALLY SPONSORED RESEARCH AND DEVELOPMENT

Not applicable.

BACKGROUND OF THE INVENTION

The invention relates to a method in winding of a web, in which method the web is wound onto a core while supported by winding drums, in which method the web is cut by a cutting device, a finished web roll is removed by means of a transfer device, a new core is moved to a space between the winding drums, and in which method the winding is stopped to remove the finished roll and to start a new roll.

The invention also relates to a device in winding of a web, which device comprises winding drums, on support and by means of which the web is wound onto a core into a web roll, which device further comprises a cutting device for cutting the web and a transfer device for removing the finished web roll and a core transfer device for taking a new core to a winding position onto support of a winding drum.

When forming a roll/rolls in winding of a web in a slitter-winder, in a situation of web set change, it is always necessary to stop the winding before starting a new winding operation and to remove the set and, after a new core has been positioned on the two-drum winder, the winding must be started again. Today, the set change time in winding of a web is in practice about 30 to 70 seconds when mechanized arrangements are used and about 2 minutes when cores are positioned manually. In this description, when referring to a core, one or more cores or other reel spools are meant around which a web, in particular a paper or board web is wound into a web roll/web rolls. By the two-drum winder (two-drum slitter-winder) is meant a winder of the two-drum type in which a web roll is formed on support of winding drums, which winding drums can be drums or sets of belt drums.

A problem in today's set change technique is the long set change time, which lowers capacity.

Corresponding prior-art methods and devices have often suffered from the drawback that it has not been possible to control the quality at the start of winding sufficiently well. For example, wrinkles may have been produced at the roll start or bottom because of problems caused by a long cut length in passing the end of the web onto a core, to which the end of the web is attached, for example, with glue or with a double-faced tape.

With respect to the prior art, reference is made to U.S. Pat. No. 3,841,578, which describes a method and a device for continuously winding material webs into individual rolls. The apparatus used in this prior-art arrangement may comprise a take-up roll, which is placed on the front side of a gap between winding drums, by which an empty reel coming from a reel storage can be pushed through the gap between the winding drums to the winding side of them.

With respect to the prior art, reference is also made to Finnish patent No. 81 551, which describes a method and a device in winding of a web. In the method, a finished web roll is removed by means of a lowering device. Partly substantially simultaneously with the roll lowering movement a new core is moved into a gap between a first winding drum and a second winding drum. The web is cut and the cut end of the web is attached to the core. In order to remove a finished roll and to start a new winding operation, the winding is slowed down to the set change speed and a rider roll is raised off the finished roll and moved rearwards relative to the finished roll. A set of belt drums is moved in a lateral direction and a new core is moved into a space defined by the first winding drum, the first drum in the set of belt drums, and the finished roll. The set of belt drums is moved back in the lateral direction and the rider roll is moved towards the new core, the rider roll being arranged to push at the same time the finished roll away from the first winding drum. Substantially at the same time, the second drum in the set of belt drums is lowered in a vertical direction, in which connection the finished roll is arranged to be moved to the lowering device. A problem with this prior-art arrangement is that, because of complexity, the structure becomes rather expensive. Moreover, this prior-art arrangement does not actually propose any arrangement for controlled holding of the core when the set of drums is brought into contact with it.

SUMMARY OF THE INVENTION

An object of the invention is to provide an improvement to the winding methods which are known at present such that the drawbacks described above are eliminated or at least minimized.

An object of the invention is to provide a method and a device in set change enabling a quicker set change than that of the prior-art arrangements.

An object of the invention is to provide an arrangement for controlled holding of the core when a set of drums is brought into contact with it.

An object of the invention is to provide a method and a device enabling the quality of winding to be controlled in particular at the beginning of winding.

The method according to the invention is mainly characterized in that, in the method, the core is moved onto support of one winding drum and a support member and held in place by means of the support member until a movable winding drum/movable winding drums has/have been moved to the starting position of winding.

The device according to the invention is in turn mainly characterized in that a support member is arranged in connection with the core transfer device to hold the core in place against one winding drum during a set change in winding, that the core transfer device of device is placed beneath the winding drums, and that at least one winding drum is movable.

In accordance with an advantageous embodiment of the invention, during set change in winding, a set change arrangement is used in which the rear drum in a winder of the two-drum type moves and a core for starting the next winding operation is fed from between the winding drums from below. At first, the core is supported between the drums against one winding drum, advantageously against the front drum, by means of the support member until the winding drums are in the starting position of winding, after which the support member used for holding the core in place is lowered and the core is in nip contact with both winding drums.

In accordance with an advantageous feature of the invention, in connection with winding, a cutting method known in itself is used for cutting the web during the slowing down of winding, which is described in the applicant's patent FI 100324.

In an embodiment in accordance with an advantageous feature of the invention, in which control of the length of the end of the web in cutting is accomplished by means of the machine direction position of a winding drum and/or by means of the position of the end of the web after the web has stopped, the wrinkles caused by too long a web end at the start of winding are eliminated. When the rear winding drum moves during set change in the running direction of the web in a direction away from unwinding, the cut end of the web moves downwards on the surface of the rear winding drum when no more web is unwound from a reeling drum to be unwound. The cutting point of the web, when using the cutting method described in the above-mentioned patent FI 100324, is not at an optimal location for ideal passing of the web around the core, and thus the movement of the winding drum provides a favourable effect in positioning the web end. The movement distance (which is dependent on the position of the rear drum at the start of set change) and the position of the web end after cutting are set by means of control and a suitable combination is selected which gives the best possible position for the web end for passing it around a core. The location of the web end after cutting can be selected from above the nip line between the finished roll and the rear drum. The location of the web end after cutting is adjusted by adjusting the moment of stopping the rotation of the drum. An advantage in the arrangement in accordance with this feature of the invention is also that the reeling drum need not be rotated during set change.

Thus, the method and the device in accordance with the invention also enable the free end or tail of the web to be positioned accurately.

In an advantageous application of the method in accordance with the invention, when a new roll is beginning to be finished and the winding is slowed down, the rear drum is moved to a set change position. A cutting blade sets out to perform a cutting function and, for starting a new winding operation, a core is lifted by a core transfer device from between the drums up. The web is held in place on the surface of a winding drum, advantageously on the surface of the rear drum, while the machine is stopped, by means of a web holder and/or by suction 32 produced by means of the winding drum. In the next stage, when the winding has been stopped, the finished roll is moved away by a transfer device by pushing from the winding position, and a core is moved onto support of one winding drum, advantageously the front drum, and of a support member, and the cutting blade is returned to the home position. To start a new winding operation, the rear drum is moved to the starting position and the support member is brought down and the core holders are locked. A rider roll is moved downwards as allowed by the transfer of the finished roll and by the movements of its transfer device. When the rider roll is in its loading position, winding is started.

With the method/device in accordance with the invention, the set change time can be shorted to about 10 seconds at its shortest, whereby the capacity of the slitter-winder increases by even 10% or more.

BRIEF DESCRIPTION OF THE DRAWINGS

In the following, the invention will be described in greater detail with reference to the figures in the accompanying drawings, to the details of which the invention is, however, not by any means meant to be strictly confined.

DESCRIPTION OF THE PREFERRED EMBODIMENTS

Figure 2:
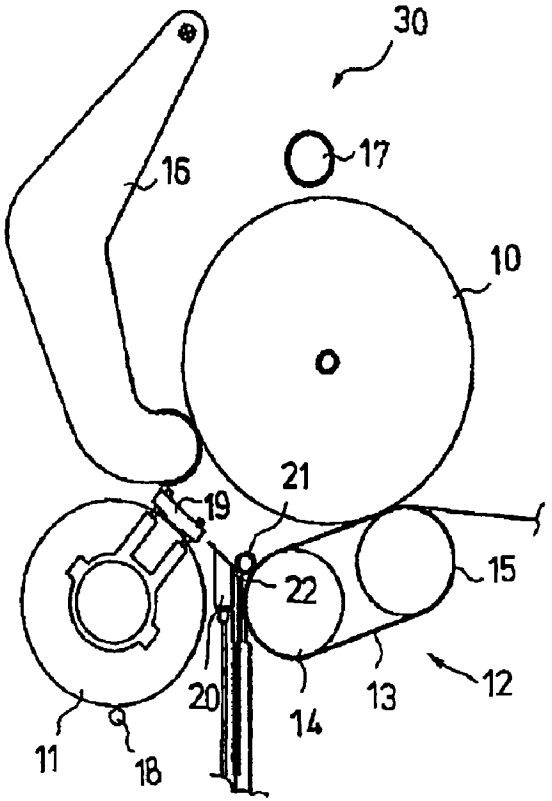
FIG. 2 is side elevational schematic view of the winder of FIG. 1 wherein a completed roll is removed from the winder and a new winding core is positioned in the winder.

In the advantageous exemplifying embodiment of the invention shown in FIGS. 1 to 6, a two-drum winder is formed of a rear winding drum 11 and a front winding drum 12, which may be formed into a set of belt drums comprising drums 14, 15 and an endless belt loop 13 arranged to run around them. A finished roll wound by the winder is designated by the reference numeral 10 and a rider roll by the reference numeral 17 and a transfer device for the finished roll by the reference numeral 16. The reference numeral 19 designates a device for cutting the web. A web holder is denoted with the reference numeral 18 and a core transfer device with the reference numeral 20, and the reference numeral 22 designates a support member for holding a core 21 in place before the winding drums 11, 12 are moved to the winding position after a set change.

Figure 1:
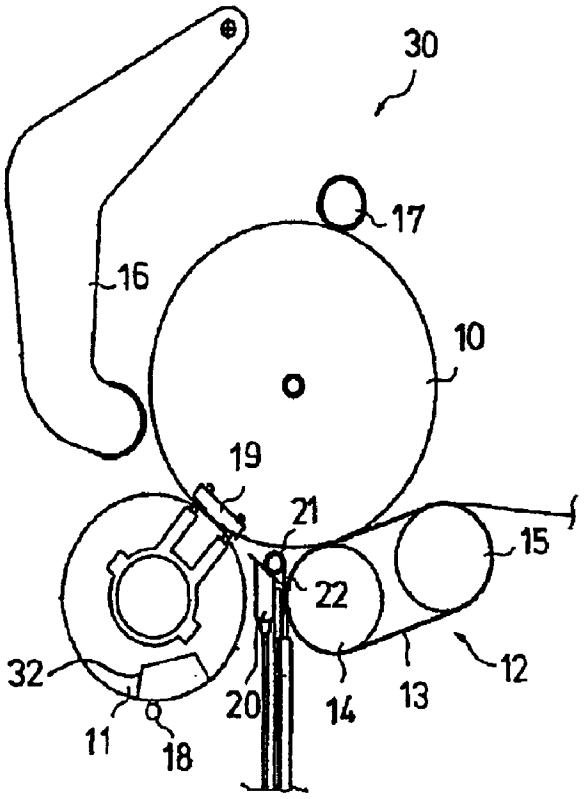
FIG. 1 is side elevational schematic view of the two-drum winder of this invention.

In the situation illustrated in FIG. 1, the roll 10 is being finished. The rider roll 17 presses the finished roll 10 and the transfer device 16 of the finished roll 10 approaches the transfer position in order to move the finished roll 10 away from the winding position. The core 21 has been brought by the core transfer device 20 into a space between the finished roll 10 and the rear winding drum 11 and the set 12 of belt drums. The core 21 is lifted up by the core transfer device 20 from the space between the rear drum 11 and the set 12 of belt drums. During winding, the rear drum 11 has moved to the initial position of set change. During the final slowing down, the web is cut by the cutting device 19 and the tail of the web is held in place against the rear drum 11 by means of the web holder 18.

In the stage shown in FIG. 2, the transfer device 16 starts pushing the finished roll 10 away from the winding drums 11, 12 and the core 21 is moved onto support of the front drum, i.e. the set 12 of belt drums. The rider roll 17 has been lifted off the finished roll 10. The core transfer device 20 raises the core 21 over the support member 22 to its position and the core 21 is held in place by means of the support member 22.

Figure 3:
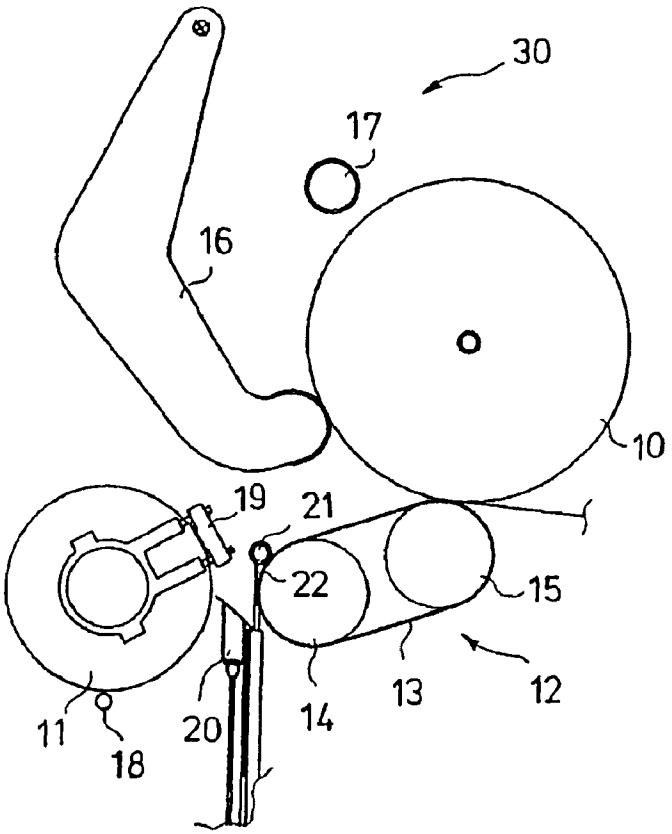
FIG. 3 is a side elevational schematic view of the winder of FIG. 1 wherein the new winding core is held in place against the first winding drum by a support member.

In the stage shown in FIG. 3, the finished roll 10 is moved further away by means of the transfer device 16 and the core transfer device 20 moves down towards its home position. The core 21 is held in place against the set 12 of belt drums by means of the support member 22. The rear drum 11 is moved towards the starting position of a new winding operation.

Figure 4:
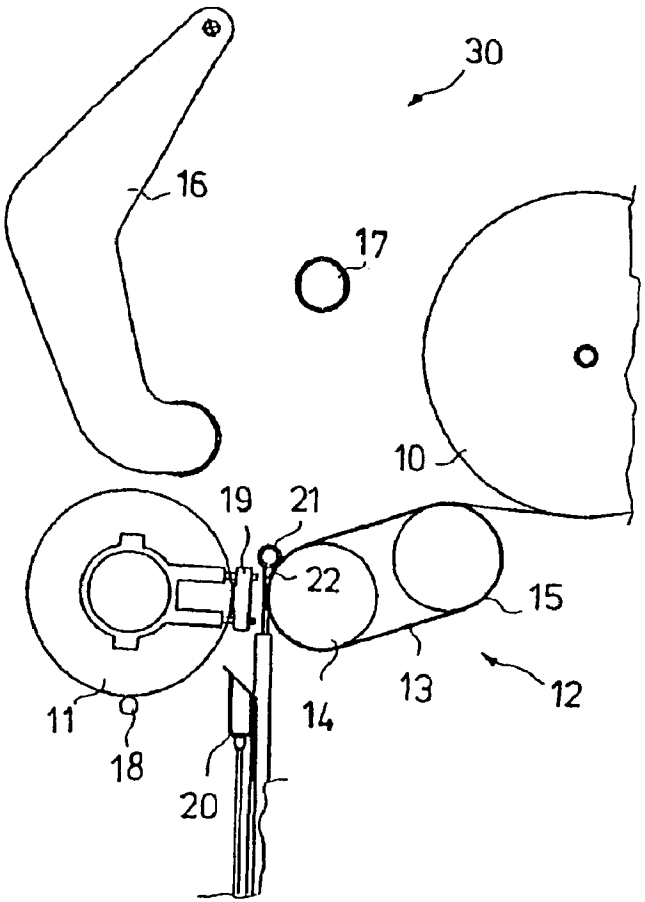
FIG. 4 is side elevational schematic view of the winder of FIG. 1 wherein a paper web is cut with a cutting device.

In the situation shown in FIG. 4, the transfer device 16 returns to its home position, the rider roll 17 starts to move towards the core 21, the rear drum 16 moves towards the starting position of winding, in which connection the distance between the rear drum 11 and the front drum 12 is reduced. The cutting device 19 moves to its home position. The end of the web moves/rolls to an advantageous starting position while the rear drum 11 rolls in the machine direction with respect to the stationary web holder.

Figure 5:
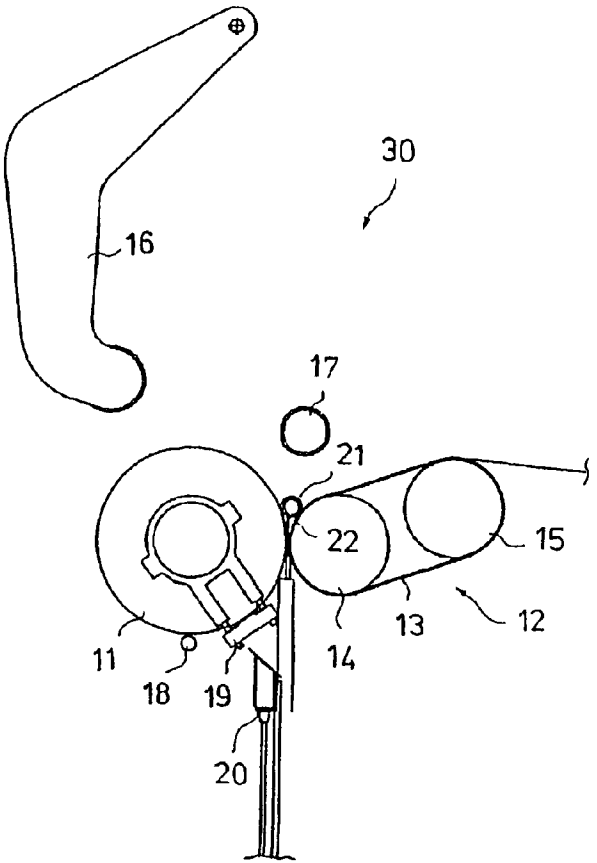
FIG. 5 is side elevational schematic view of the winder of FIG. 1 wherein the paper web is attached to a new winding core positioned in the winder.

In the situation shown in FIG. 5, the support member 22 of the core 21 starts to move towards its home position and the rear winding drum 11 has moved to the starting position of winding and the tail of the web has reached its position with respect to the core 21 and the rider roll 17 moves towards the core 21.

Figure 6:
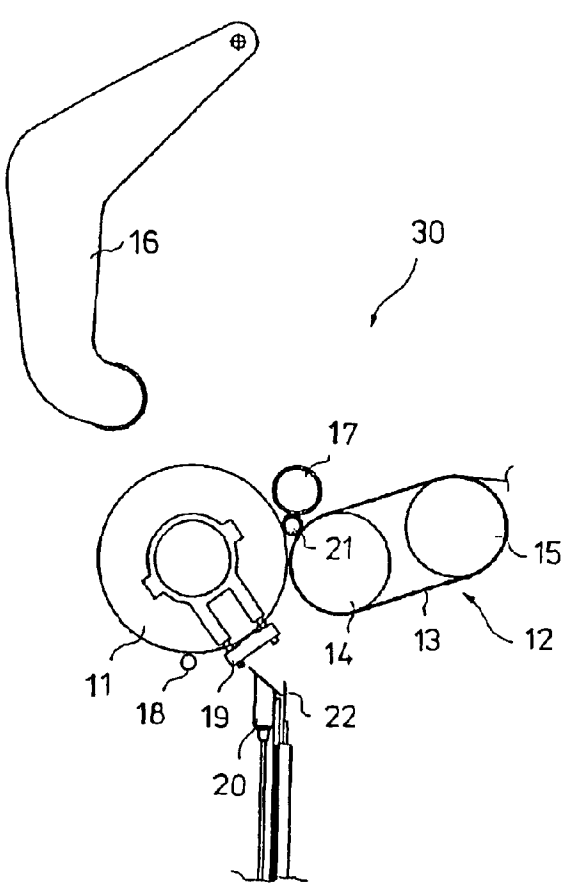
FIG. 6 is side elevational schematic view of the winder of FIG. 1 wherein the new winding core is engaged with a rider roll, and the support member is withdrawn.

In the situation shown in FIG. 6, the rider roll 17 is in nip contact and winding is started.

Above, the invention has been described with reference to one of its advantageous exemplifying embodiments, but the invention is by no means meant to be narrowly confined to the details of it.

What is claimed is:

1. A method of winding a web roll on a core comprising the steps of:

while a first winding drum is separated from a second winding drum by a space, moving the core on a core transfer device to the space between the first winding drum and the second winding drum and moving the core on the core transfer device into supporting engagement with the first winding drum and a core support member;

holding the core in place against the first winding drum with the core support member, while the second winding drum is brought into engagement with the core with the second drum in a starting position for winding;

winding a web onto the core while supported by the first winding drum and the second winding drum to form a finished roll;

cutting the web with a cutting device, wherein winding is stopped to remove the finished roll and to start a new roll;

removing the finished roll with a transfer device; and moving a new core on the core transfer device to a space between the first winding drum and the second winding drum.

2. The method of claim 1, wherein prior to stopping winding, the web roll is slowed to a stop, and during final slowing down the web is cut by the cutting device to form a web end, wherein the web end is held in connection with the second winding drum by a holder member while the new core is moved to the space between the winding drums.

3. The method of claim 1, further comprising the step of:

when a new winding operation is beginning to be finished and the winding is slowed down, the second winding drum is moved to a set change position and the transfer device is moved close to the web roll;

following cutting the web with the cutting device, the new core is lifted upwards by the core transfer device between the first winding drum and the second winding drum, wherein the new core is held against the first winding drum by the support member:

after which the core transfer device is brought downwardly to a home position;

after which the finished roll is moved away by the transfer device; and the second winding drum is moved to a starting position and the core support member is removed and a rider roll is moved down, a web holder is disengaged and a new winding operation is started.

4. The method of claim 2, wherein the cut length of the web is adjusted by the machine direction movement of the second winding drum or by the position of the web end after the web has stopped.

5. The method of claim 1, wherein the first winding drum is a front winding drum.

6. The method of claim 1, wherein the second winding drum is a rear winding drum.

7. The method of claim 1, wherein the first winding drum is formed of two drums and an endless belt loop arranged to run around the two drums.

8. The method of cam 1 wherein the web roll that is being formed is loaded by a rider roll.

9. The method of claim 1 wherein the new core is moved, at least in part, substantially simultaneously with the transfer of the finished roll.

10. A device for winding a web roll on a core, the device comprising:

a first winding drum;

a second winding drum, wherein at least one of the first winding drum and the second winding drum are mounted for motion toward and away from the other, the second winding drum, and the first winding drum being positionable to support and wind a web onto the core positioned between said first winding drum and said second winding drum;

a cutting device for cutting the web;

a transfer device mounted to remove a finished web roll from between the first winding drum and the second winding drum;

a core transfer device, mounted for moving a new core to a winding position supported by said first winding drum, the core transfer device positioned beneath the first winding drum and the second winding drum; and a core support member movable with respect to the core transfer device and arranged in connection with the core transfer device to hold the core in place against the first winding drum during a set change in winding.

11. The device of claim 10, wherein the device further comprises a holder member operable to hold the web at a given location against the second winding drum movable toward and away form the first winding drum during a set change in winding.

12. The device of claim 10, wherein the web is arranged to be cut by the cutting device to a cut length such that motion of the second winding drum toward and away from the first winding drum and the position of the end of the web is adjusted after the web has stopped.

13. The device of claim 10, wherein at least one of the first winding drum, and the second winding drum is formed of two drums and an endless belt loop arranged to run around the two drums.

14. The device of claim 10, further comprising a rider roll mounted for pressing a web roll being formed between the first winding drum and the second winding drum.

15. The device of claim 10, wherein the second movable winding drum is a rear winding drum.

16. The device of claim 15, further comprising a holder member operable to hold the web at a given location against the second winding drum during a set change.

17. The device of claim 10, wherein the support member is placed such that the core can be held in place against the first winding drum.

18. The method of claim 1, wherein prior to stopping winding, the web roll is slowed to a stop, and during final slowing down the web is cut by the cutting device to form a web end, wherein the web end is held in connection with the second winding drum by means of suction while the new core is moved to the space between the winding drums.

19. The device of claim 10, wherein the device further comprises a means of suction device in the second winding drum operable to hold the web at a given location against the second winding drum movable toward and away from the first winding drum during a set change in winding.

* * * * *